US010479070B2

(12) United States Patent
Livingston

(10) Patent No.: US 10,479,070 B2
(45) Date of Patent: Nov. 19, 2019

(54) SCREEN PRINTING ADAPTER DEVICE

(71) Applicant: Livingston Systems, LLC, Denver, CO (US)

(72) Inventor: Darren Livingston, Arvada, CO (US)

(73) Assignee: Livingston Systems, LLC, Denver, CO (US)

( * ) Notice: Subject to any disclaimer, the term of this patent is extended or adjusted under 35 U.S.C. 154(b) by 50 days.

(21) Appl. No.: 15/703,689

(22) Filed: Sep. 13, 2017

(65) Prior Publication Data

US 2018/0072042 A1 Mar. 15, 2018

Related U.S. Application Data

(60) Provisional application No. 62/394,425, filed on Sep. 14, 2016.

(51) Int. Cl.

| | |
|---|---|
| ***B41F 15/34*** | (2006.01) |
| ***B41F 15/44*** | (2006.01) |
| *B41J 3/407* | (2006.01) |
| *B41J 11/02* | (2006.01) |

(52) U.S. Cl.

CPC ..... *B41F 15/34* (2013.01); *B41F 15/44* (2013.01); *B41J 3/4078* (2013.01); *B41J 11/02* (2013.01)

(58) Field of Classification Search

CPC ..... B41F 15/34
USPC ..... 101/126
See application file for complete search history.

(56) References Cited

U.S. PATENT DOCUMENTS

| | | | | |
|---|---|---|---|---|
| D246,083 | S | 10/1977 | Auersperg | |
| 4,908,912 | A | 3/1990 | Grant | |
| 5,107,758 | A | 4/1992 | Withers | |
| 6,651,554 | B1 | 11/2003 | Williams | |
| 7,413,301 | B2 | 8/2008 | Niimi | |
| D648,784 | S | 11/2011 | Horito et al. | |
| D702,529 | S | 4/2014 | Diez Herrera | |
| 9,302,462 | B2 | 4/2016 | Livingston | |
| D765,775 | S | 9/2016 | Livingston | |
| 9,849,665 | B2 | 12/2017 | Livingston | |
| 2004/0000240 | A1* | 1/2004 | Oleson | B41F 15/18 101/126 |

(Continued)

OTHER PUBLICATIONS

Tag Along, dated Oct. 18, 2014, [online], [site visited May 5, 2016]. Available from internet, <URL: https://www.youtube.com/watch?v=-3KWYB9gmLA>.

*Primary Examiner* — Walter L Lindsay, Jr.
*Assistant Examiner* — Philipmarcus T Fadul
(74) *Attorney, Agent, or Firm* — Trenner Law Firm, LLC; Mark D. Trenner

(57) ABSTRACT

A screen printing adapter device is disclosed. In an example, the screen printing adapter device includes a body configured as an accessory to a printing board having a tag printing surface. The body is attached to a screen and moves on and off of the printing board along with the screen for a screen printing operation. The body supports areas of the screen for a squeegee that are otherwise unsupported by the printing board. The example screen printing adapter device also includes a shoulder edge of the body shaped to fit adjacent and conform to a shoulder edge of the printing board. The example screen printing adapter device includes a collar edge of the body. In an example, the collar edge of the body is shaped to fit fully around a perimeter of the tag printing surface of the printing board.

18 Claims, 6 Drawing Sheets

(56) References Cited

U.S. PATENT DOCUMENTS

| | | | |
|---|---|---|---|
| 2015/0360460 | A1 | 12/2015 | Livingston |
| 2016/0159075 | A1 | 6/2016 | Livingston |
| 2018/0072044 | A1 | 3/2018 | Livingston |

* cited by examiner

SCREEN PRINTING ADAPTER DEVICE

PRIORITY CLAIM

This application claims the priority benefit of U.S. Provisional Patent Application No. 62/394,425 filed Sep. 14, 2016 titled "Screen Printing Device" of Darren Livingston, hereby incorporated by reference for all that it discloses as though fully set forth herein.

BACKGROUND

Screen printing is based on a screen with some holes blocked and other left open to allow ink to pass through at chosen locations to create a desired pattern. The screen is placed over a textile to be decorated with a small gap, called "off-contact," usually 1/16 to 1/4 inch. Ink is then pushed through the screen at the desired locations with pressure applied by a squeegee pulled or pushed over the screen with a downward force, resulting in the screen contacting the textile and depositing ink. Additional colors may be applied using a separate screen for each color. The result is a printed image on the textile. Digital, or direct-to-garment printing, utilizes a computer, software, and an ink-jet printer to print the image directly onto the textile. Both of these techniques enable printing on a smooth surface, such as a shirt.

When a squeegee or flood bar presses on a screen and moves over the edge of a platen, the screen can wear or become damaged at that transition, or cause issues with print quality near that transition.

DETAILED DESCRIPTION

Figure 1A:
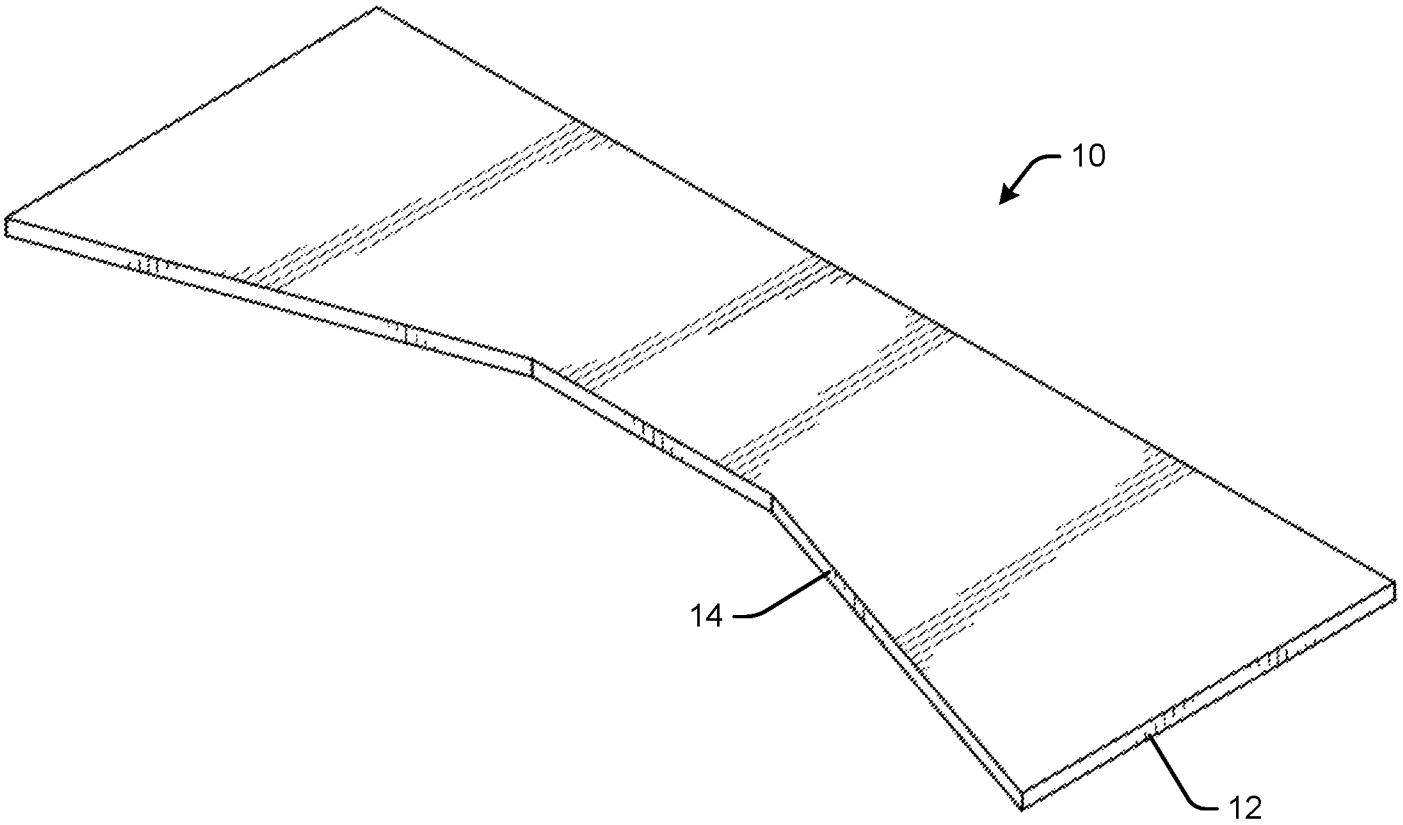
FIGS. 1A and 1B show an example screen printing adapter device.

Manufacturers and/or printers often want (or are required by law) to include a label with their printed product. In the past, these labels were printed separately and attached to the textile (e.g., by sewing below the inner collar of a shirt). More recently, these labels have been printed (e.g., screen printed) directly on the textile to reduce costs associated with applying a separate label and increase comfort for the wearer. A textile printing apparatus and method is disclosed which enables printing labels directly on the textile, in co-owned U.S. Pat. No. 9,302,462 for "Textile Printing Apparatus and Method" issued Apr. 5, 2016, hereby incorporated by reference for all that is disclosed.

An example of the textile printing apparatus disclosed in U.S. Pat. No. 9,302,462 includes a first printing surface configured to support a first portion of a textile to be printed on. The example textile printing apparatus also includes a second printing surface configured to support a second portion of the textile in substantially a same printing plane as the first portion of the textile. The example textile printing apparatus also includes a slot formed adjacent the second printing surface. For a printing operation, a body of the textile is mounted over the first printing surface, and an inner portion of the textile is pulled through the slot and mounted over the second printing surface. The printing operation proceeds in substantially the same printing plane onto both the outer printing surface and the inner printing surface without removing the textile during the printing operation.

A screen printing adapter device is disclosed herein that supports the flood bar and/or squeegee on the mesh screen where there is no platen beneath the screen, or where there are gaps in the platen, such as the platen disclosed in U.S. Pat. No. 9,302,462. In an example, the screen printing adapter device disclosed herein may be rigid (e.g., made of aluminum or other solid surface) and placed beneath the screen and/or may be attached to the screen of the screen printing device.

In an example, the screen printing adapter device disclosed herein may move with the screen (e.g., not with the platen) to raise and lower during a screen printing operation. The screen printing adapter device may also be spaced away from the screen to match the off-contact between the screen and platen. The example screen printing device disclosed herein supports areas of the screen that are unsupported by the platen holding the garment or other article. As such, the example screen printing adapter device disclosed herein may increase the longevity of the screen and quality of the print.

It is noted that as used herein, the terms "includes" and "including" mean, but is not limited to, "includes" or "including" and "includes at least" or "including at least." The term "based on" means "based on" and "based at least in part on." Although the term "shirt" and "shirtboard" or "shirt board" are used herein, the platen is not limited to use with shirts and may be implemented with other articles to be printed on. In addition, the platen is not limited to use with heat pressing, and may also be implemented for other applications.

Figure 1B:
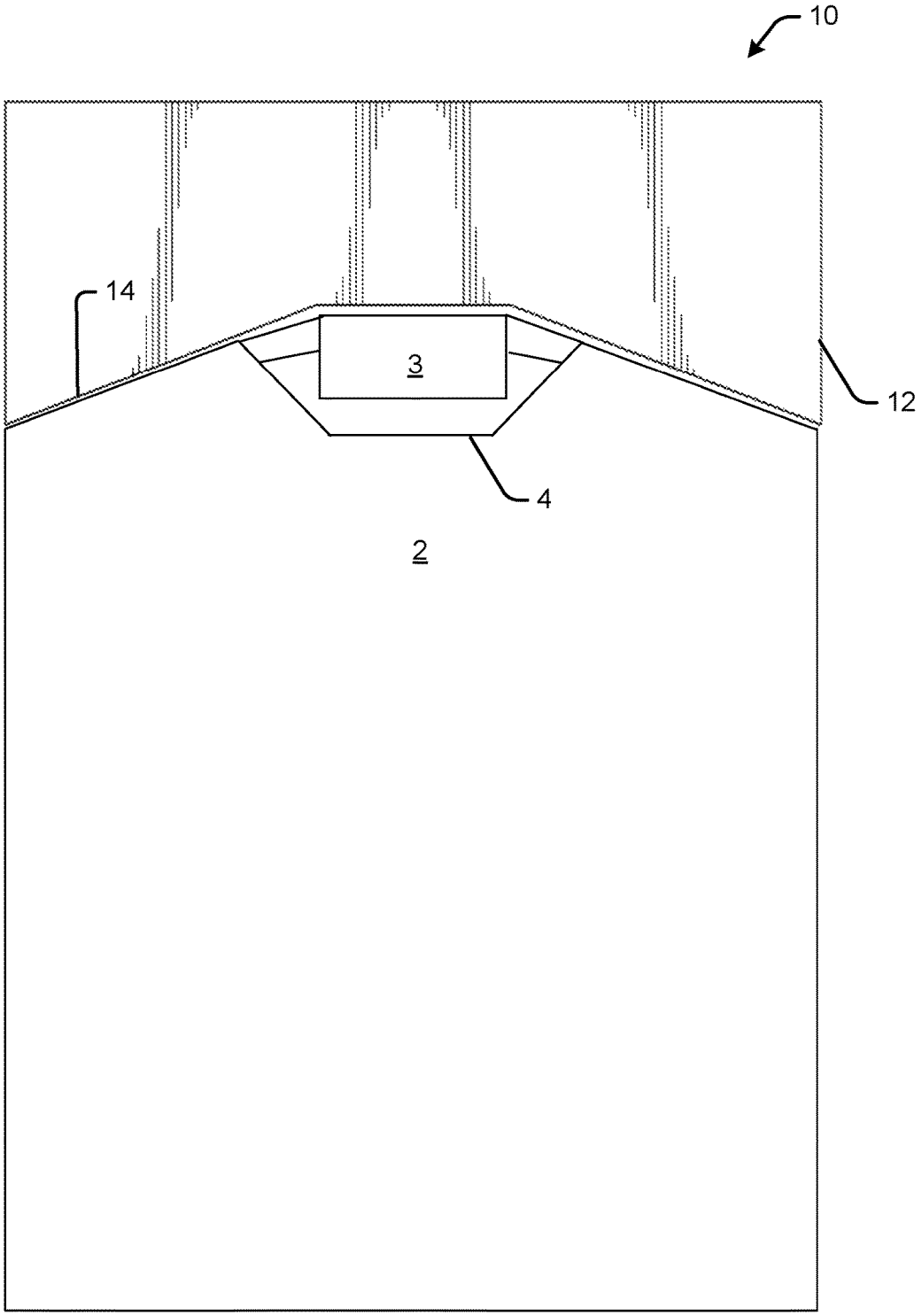
Figure 2A:
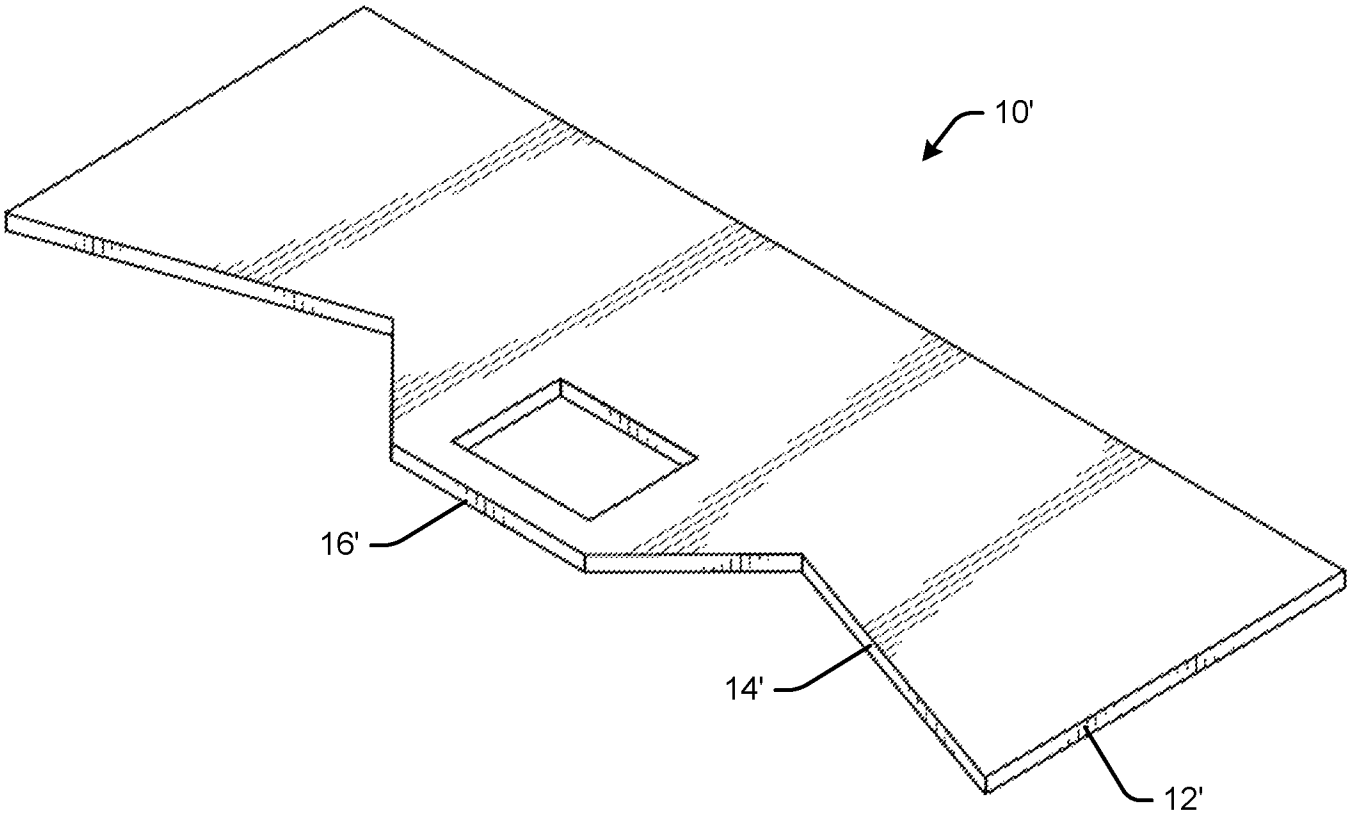
FIGS. 2A and 2B show an example screen printing adapter device.
Figure 2B:
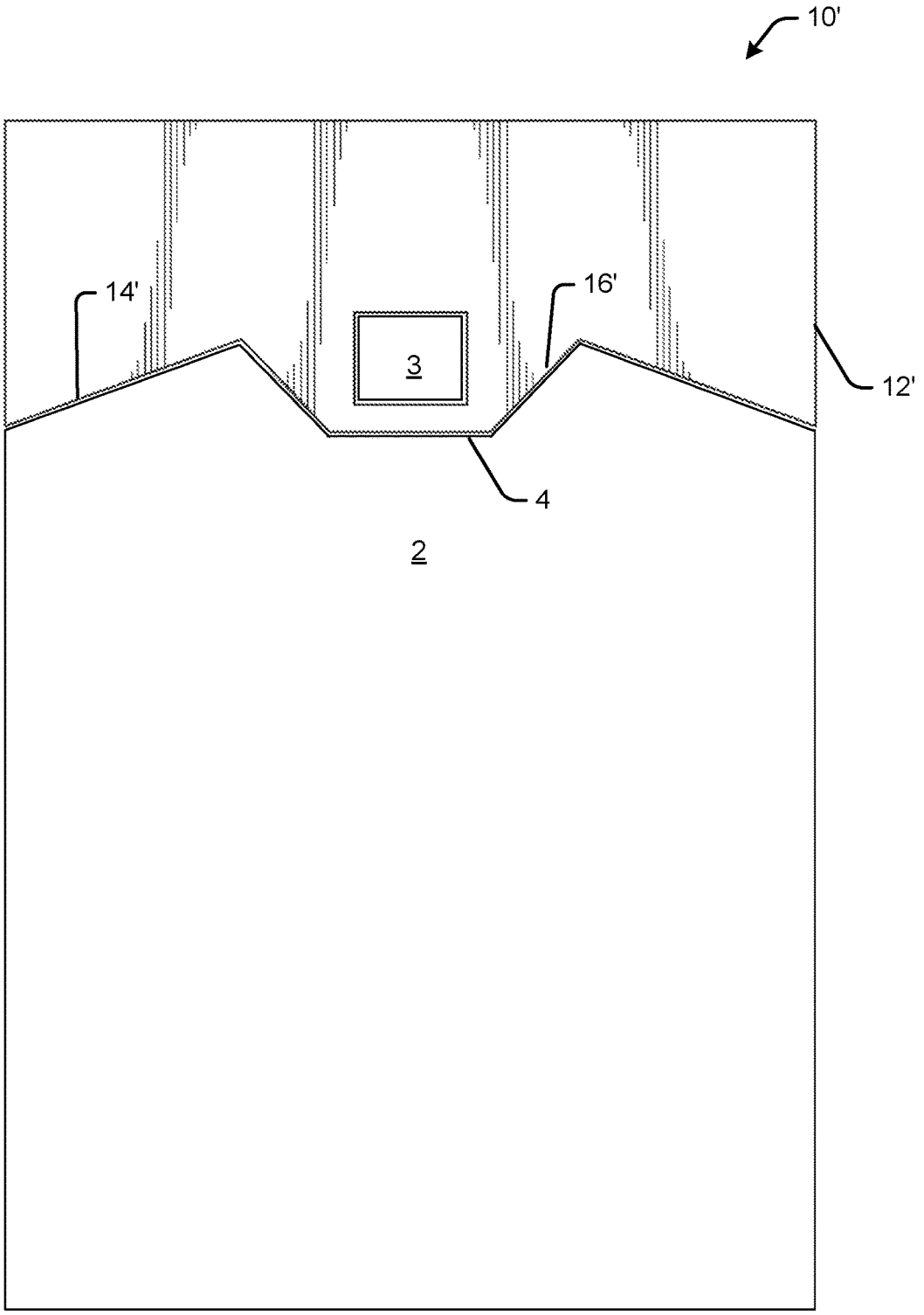

FIGS. 1A and 1B show an example screen printing adapter device 10. FIG. 1A shows a top perspective view of the adapter device 10. FIG. 1B shows a top view of the adapter device 10 as it may be positioned adjacent a platen 2. FIGS. 2A and 2B show an example screen printing adapter device 10'. FIG. 2A shows a top perspective view of the adapter device 10'. FIG. 2B shows a top view of the adapter device 10' as it may be positioned adjacent a platen 2.

The example screen printing adapter device 10 and 10' may be implemented as an accessory for a screen printing device 1 (see, e.g., FIG. 2) to a printing board or platen 2. In an example, the platen 2 may also have a tag printing surface 3.

An example screen printing adapter device 10 may include a body 12 configured as an accessory to a printing board 2 having a tag printing surface 3. A shoulder edge 14 of the body 12 is shaped to fit adjacent and conform to a shoulder edge 4 of the printing board or platen 2. The body 12 may also have a collar edge 16. The collar edge 16 of the body 12 is shaped to fit adjacent the tag printing surface 3 of the printing board 2, e.g., as shown in FIG. 1A. As such, the screen printing adapter device 10 may be configured for a printing board configured with a tag printing surface.

Another example screen printing adapter device 10' may include a body 12' configured as an accessory to a printing board 2 having a tag printing surface 3. A shoulder edge 14' of the body 12' is shaped to fit adjacent and conform to a shoulder edge 4 of the printing board or platen 2. The body 12' may also have a collar edge 16'. The collar edge 16' of the body 12' is shaped to fit fully around a perimeter of the tag printing surface 3 of the printing board 2, e.g., as shown in FIG. 1B. For example, the screen printing adapter device 10 may have an opening formed through the body 12' such that there are substantially no gaps or spaces between the platen 2 for the shirt body and the tag printing surface 3.

It is noted that the screen printing adapter device is referred to herein primarily with reference to the example 10 shown in FIG. 1A. However, the disclosure is applicable to both examples 10 and 10'.

In an example, the body 12 is non-porous so that ink does not penetrate the body 12. The body 12 may be any suitable dimension. In an example, the body 12 may also have a thickness that is less than a thickness of the shirt board 2. In another example, the body 12 has a thickness that is about the same as a thickness of the shirt board 2.

In an example, the screen printing adapter device 10 is attached to a screen 5 (see, e.g., FIGS. 3 and 4) and moves with the screen 5 during a screen printing operation. It is noted that the body 12 is shown being clamped to the screen 5 in the drawings (e.g., FIGS. 3 and 4). However, the body 12 may be temporarily and/or permanently attached adjacent the screen 5 by any desired means. In another example, the screen printing adapter device 10 may be utilized separate from the screen (e.g., attached to the platen).

In an example, the body 12 of the example screen printing adapter device 10 is attached to a screen 5. As such, the example screen printing adapter device 10 moves on and off (e.g., can be raised and/or lowered) the printing board 2 by moving or raising and lowering the screen 5 of the screen printing device 1, e.g., during a screen printing operation. For example, the screen printing adapter device 10 is raised with the screen 5 so that a shirt can be threaded onto the platen 2. Then the example screen printing adapter device 10 is lowered with the screen 5 so that the shirt can be screen printed on the platen 2. The example screen printing adapter device 10 is then raised with the screen following the screen printing operation, to permit the shirt to be removed from the platen 2.

In an example, the body 12 of the example screen printing adapter device 10 is configured to support areas of the screen for a squeegee that are otherwise unsupported by the printing board 2. For example, those areas may include the area adjacent the shoulder of the printing board 2. By providing support, the body 12 is configured to increase longevity of the screen 5 through multiple screen printing operations. By providing support, the body 12 is also configured to increase quality of a print on a shirt on the shirt board 2 during a screen printing operation.

Before continuing, it should be noted that the examples described above are provided for purposes of illustration, and are not intended to be limiting. Other devices and/or device configurations may be utilized to carry out the operations described herein.

Figure 3:
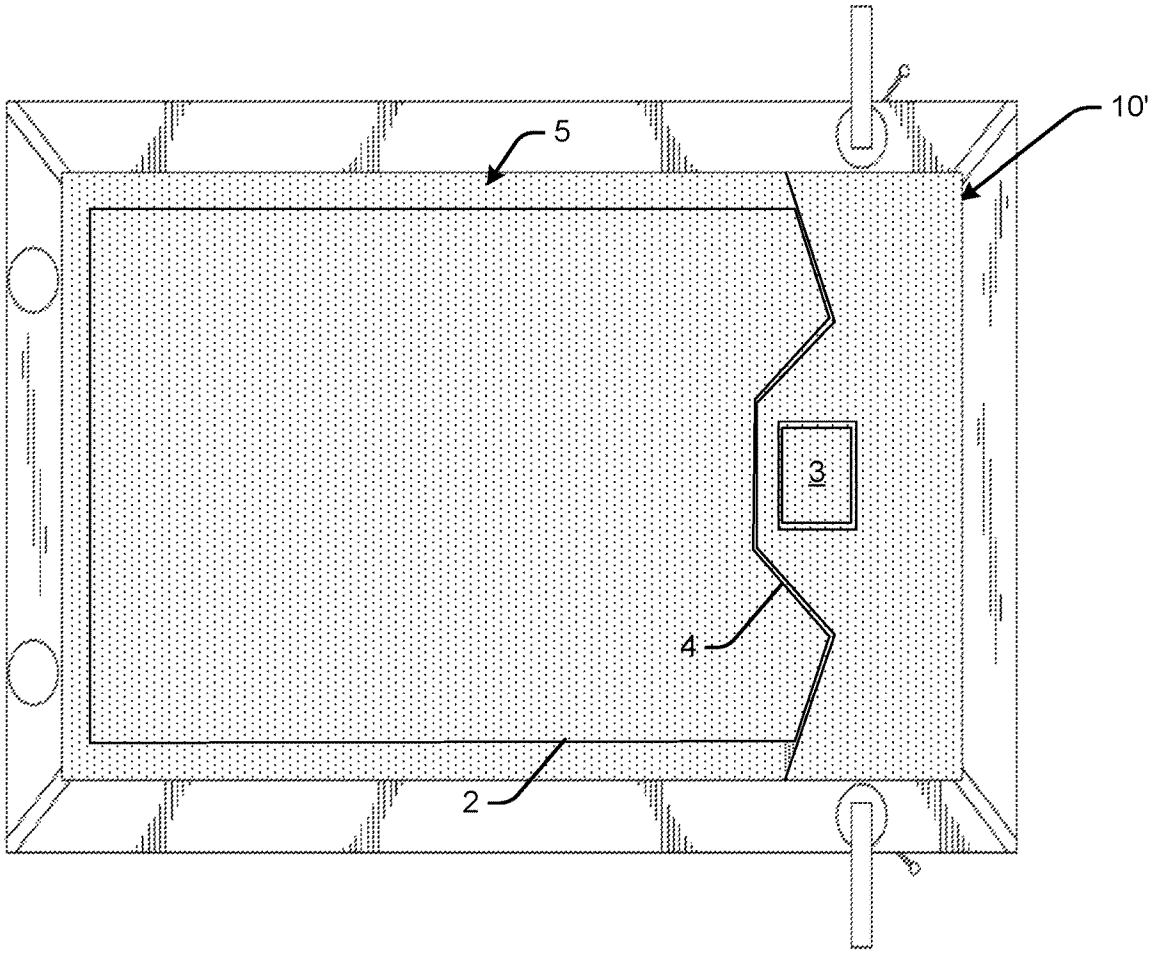
FIGS. 3-4 are illustrations of an example screen printing adapter device assembled for a screen printing operation.
Figure 4:
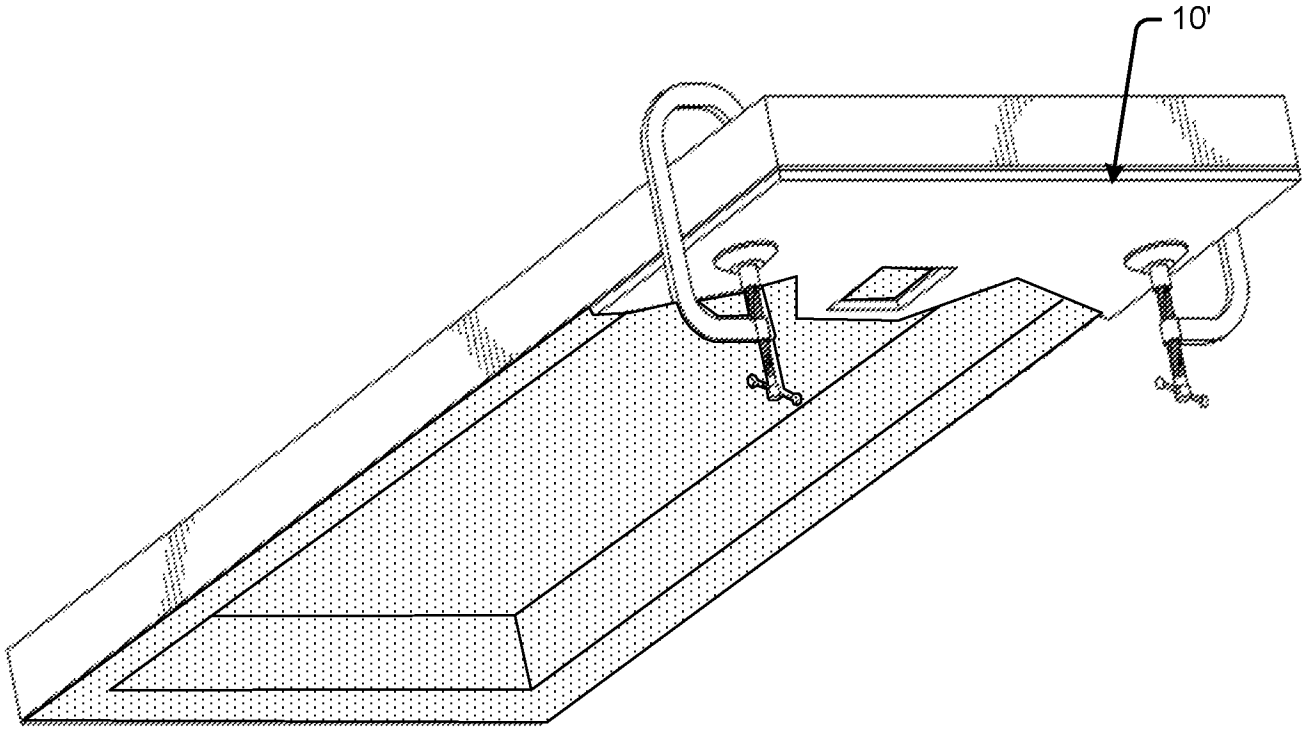

FIGS. 3-4 are illustrations of an example screen printing adapter device 10' assembled for a screen printing operation. In an example, a garment (e.g., a shirt) or other article to be printed on may be loaded onto the platen 2. The inside portion of the shirt 6 may be pulled through the cutout 7 of the platen 2 so that the label area (inside neck area of the shirt) is raised on the tag printing surface 3. This provides the label area in the neck of the shirt on the same plane as the front of the shirt for the screen printing operation. The screen 5, having the accessory thereon, may then be lowered onto the platen 2, such that the body 12 of the example screen printing adapter device 10' provides support for a squeegee as it is run across the screen 5 during a screen printing operation.

In an example, the example screen printing adapter device 10' (or device 10) supports areas of the screen that are otherwise unsupported by the printing board 2. As such, the example screen printing adapter device 10' (or device 10) may increase longevity of the screen 5, relative to a screen printing device without the adapter. The example screen printing adapter device 10' (or device 10) may also increase quality of the print, relative to a screen printing device without the adapter.

The operations shown and described herein are provided to illustrate example implementations. It is noted that the operations are not limited to the ordering shown. Still other operations may also be implemented.

It is noted that the examples shown and described are provided for purposes of illustration and are not intended to be limiting. Still other examples are also contemplated.

The invention claimed is:

1. A screen printing adapter device, comprising:

a body configured as an accessory to a printing board having a tag printing surface;

a collar edge of the body shaped to fit fully around a perimeter of the tag printing surface of the printing board; and a shoulder edge of the body shaped to fit adjacent and conform to a shoulder edge of the printing board.

2. The screen printing adapter device of claim 1, wherein the collar edge of the body is shaped to fit adjacent the tag printing surface of the printing board.

3. The screen printing adapter device of claim 1, wherein the body is attached to a screen and moves on and off of the printing board along with the screen for a screen printing operation.

4. The screen printing adapter device of claim 1, wherein the body is configured to support areas of the screen for a squeegee that are otherwise unsupported by the printing board.

5. The screen printing adapter device of claim 1, wherein the body is configured to increase longevity of the screen through multiple screen printing operations.

6. The screen printing adapter device of claim 1, wherein the body is configured to increase quality of a print on a shirt on the shirt board during a screen printing operation.

7. The screen printing adapter device of claim 1, wherein the body is non-porous.

8. The screen printing adapter device of claim 1, wherein the body has a thickness that is less than a thickness of a shirt board.

9. The screen printing adapter device of claim 1, wherein the body has a thickness that is about the same as a thickness of a shirt board.

10. The screen printing adapter device of claim 1, wherein the body is configured to support areas of the screen for a squeegee that are otherwise unsupported by the printing board.

11. The screen printing adapter device of claim 1, wherein the body is configured to increase longevity of the screen through multiple screen printing operations.

12. The screen printing adapter device of claim 1, wherein the body is configured to increase quality of a print on a shirt on the shirt board during a screen printing operation.

13. A screen printing adapter device, comprising:

a body configured as an accessory to a printing board having a tag printing surface, the body is attached to a screen and moves on and off of the printing board along with the screen for a screen printing operation;

a shoulder edge of the body shaped to fit adjacent and conform to a shoulder edge of the printing board; and a collar edge of the body.

14. The screen printing adapter device of claim 13, wherein the collar edge of the body is shaped to fit adjacent the tag printing surface of the printing board.

15. The screen printing adapter device of claim 13, wherein the collar edge of the body is shaped to fit fully around a perimeter of the tag printing surface of the printing board.

16. A screen printing adapter device, comprising:

a body configured as an accessory to a printing board having a tag printing surface, wherein the body is attached to a screen and moves on and off of the printing board along with the screen for a screen printing operation and supports areas of the screen for a squeegee that are otherwise unsupported by the printing board;

a shoulder edge of the body shaped to fit adjacent and conform to a shoulder edge of the printing board; and a collar edge of the body.

17. The screen printing adapter device of claim 16, wherein the collar edge of the body is shaped to fit fully around a perimeter of the tag printing surface of the printing board.

18. A screen printing adapter device, comprising:

a body configured as an accessory to a printing board having a tag printing surface, the body attached to a screen and moves on and off of the printing board along with the screen for a screen printing operation; and a shoulder edge of the body shaped to fit adjacent and conform to a shoulder edge of the printing board.

* * * * *